US010192729B2

(12) United States Patent
Schwieters et al.

(10) Patent No.: US 10,192,729 B2
(45) Date of Patent: Jan. 29, 2019

(54) APPARATUS AND METHOD FOR STATIC GAS MASS SPECTROMETRY

(71) Applicant: Thermo Fisher Scientific (Bremen) GmbH, Bremen (DE)

(72) Inventors: Johannes Schwieters, Ganderkesee (DE); Dougal Hamilton, Heald Green (GB)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/612,146

(22) Filed: Jun. 2, 2017

(65) Prior Publication Data

US 2017/0352528 A1 Dec. 7, 2017

(30) Foreign Application Priority Data

Jun. 6, 2016 (GB) ..... 1609822.0

(51) Int. Cl.
*H01J 49/30* (2006.01)
*H01J 49/24* (2006.01)
*H01J 49/04* (2006.01)

(52) U.S. Cl.
CPC ..... *H01J 49/30* (2013.01); *H01J 49/0422* (2013.01); *H01J 49/0468* (2013.01); *H01J 49/24* (2013.01)

(58) Field of Classification Search
None
See application file for complete search history.

(56) References Cited

U.S. PATENT DOCUMENTS 3,493,742 A * 2/1970 Cason ..... H01J 49/022 250/286
3,522,430 A * 8/1970 Jenckel ..... H01J 49/14 250/282

(Continued)

FOREIGN PATENT DOCUMENTS

WO 2012007559 A2 1/2012
WO WO-2016092696 A1 * 6/2016 ..... H01J 49/14

OTHER PUBLICATIONS

Farley et al., "A double-spike method for K-Ar measurement: A technique for high precision in situ dating on Mars and other planetary surfaces," Geochimica & Cosmochimica Acta., 110, 1-12, 2013.

(Continued)

*Primary Examiner* — Michael J Logie
(74) *Attorney, Agent, or Firm* — A. J. Gokcek

(57) ABSTRACT

A method of static gas mass spectrometry is provided. The method includes the steps of: introducing a sample gas comprising two or more isotopes to be analyzed into a static vacuum mass spectrometer at a time, $t_0$; operating an electron impact ionization source of the mass spectrometer with a first electron energy below the ionization potential of the sample gas for a first period of time that is following $t_0$ until a time $t_1$; and operating the electron impact ionization source with a second electron energy at least as high as the ionization potential of the sample gas for a second period of time that is after time $t_1$. The first time period from $t_0$ to $t_1$ is a period corresponding to a period taken for the isotopes of the sample gas to equilibrate in the mass spectrometer. A constant ion source temperature is preferably maintained. Also provided is a static gas mass spectrometer.

17 Claims, 4 Drawing Sheets

(56) References Cited

U.S. PATENT DOCUMENTS

| | | | | | |
|---|---|---|---|---|---|
| 4,023,038 | A * | 5/1977 | Janes | B01D 59/34 | 204/157.22 |
| 4,107,537 | A * | 8/1978 | Forsen | H01J 49/10 | 250/423 P |
| 4,786,478 | A * | 11/1988 | Ahmed | B01D 59/34 | 204/157.2 |
| 5,756,996 | A * | 5/1998 | Bier | H01J 49/145 | 250/286 |
| 2004/0245451 | A1 * | 12/2004 | Schwartz | H01J 49/0027 | 250/282 |
| 2013/0103337 | A1 * | 4/2013 | Eiler | G06F 19/703 | 702/86 |

OTHER PUBLICATIONS

Pinti et al., "Separation of noble gas mixtures from petroleum and their isotopic analysis by mass spectrometry," J. of Chromatography A, 824, 109-117, 1998.

Zadnik et al, Revised Isotopic Composition of Terrestrial Mercury, Int'l J. of Mass Spec. and Ion Processes, 1989, 103-110, 89.

* cited by examiner

APPARATUS AND METHOD FOR STATIC GAS MASS SPECTROMETRY

CROSS-REFERENCE TO RELATED APPLICATION

This application claims the priority benefit under 35 U.S.C. § 119 to British Patent Application No. 1609822.0, filed on Jun. 6, 2016, the disclosure of which is incorporated herein by reference.

FIELD OF THE INVENTION

The invention relates to the field of mass spectrometry. The invention in particular relates to static gas mass spectrometry, for example for isotope ratio measurements.

BACKGROUND OF THE INVENTION

Noble gas mass spectrometry is important for radiometric dating or isotope geochemistry, for example argon-argon dating and helium or xenon isotope analysis. Noble gas mass spectrometry usually uses a static gas mass spectrometer in which a gaseous sample containing the noble gas or gases of interest is fed into a mass spectrometer and then left in the spectrometer without pumping during the mass analysis. A characteristic feature of static mass spectrometers is therefore that they stay evacuated during analysis. Static mass spectrometers are used when a very high degree of sensitivity is required. Analysis is typically conducted for detecting the presence of minute quantities of noble gases (He, Ne, Ar, Kr, Xe), although static mass spectrometers may also be capable of analyzing other gases, such as $CO_2$ or $N_2$ for example. Examples of such instruments include the Helix™ and Argus™ instruments from Thermo Scientific™.

In more detail, in noble gas isotope ratio mass spectrometry, the sample gas is prepared, typically from a solid sample, in a sample preparation gas line, which for instance can be connected to a means of heating, such as a furnace at high temperature or a laser heating device, to release small amounts of sample gas trapped inside a solid sample, such as a small crystal or mineral(s) by sample heating. The sample gas comprises one or more noble gases to be analyzed. In other cases the noble gas can also be obtained and/or cleaned up from a gas sample directly, for instance from an air gas sample.

One or more traps, such as cold traps, and/or chemical getters, such as getter pumps, are used in the preparation line for sample gas clean up. The traps and/or getters act to remove active gases from the sample gas, thereby leaving the inert noble gases for analysis. During sample preparation, typically very small amounts of noble gases (for example ca. 1 μl at standard pressure, or less) are released from the solid sample and cleaned up with the chemical getters and cold traps before the gas is introduced into the evacuated mass spectrometer by opening an inlet valve to the mass spectrometer. The gas may be admitted from a vacuum of around $10^{-4}$ mbar in the sample preparation line to a high vacuum or ultra high vacuum in the mass spectrometer.

The time at which the gas is introduced into the mass spectrometer is defined as "time zero" in the prior art. Before introduction of the gas into the evacuated mass spectrometer, the vacuum pumps of the spectrometer are isolated from the spectrometer such that no gas is pumped from the mass spectrometer during the analysis time. Thus, the analysis is performed under a static vacuum condition. The static vacuum condition requires a sealed mass spectrometer (preferably sealed to high or ultra high vacuum) having clean internal surfaces with very low outgassing rates (usually as a result of a bake-out procedure).

The ionization of the sample gas in the static gas mass spectrometer is usually achieved using electron impact ionization inside an ionization volume of a Nier type ion source. The ionized noble gas species are extracted out of the ionization volume by electric fields and accelerated into the mass analyser, which usually is a magnetic sector mass analyser, but it could alternatively be another type, such as a quadrupole mass analyser or a time of flight mass analyser. A multicollector, for example comprising a plurality of Faraday cups and/or electron multipliers (usually a combination of the two types), is usually used for detection of the ions, in particular with the preferred magnetic sector mass analyser.

In the analysis, isotope abundances and typically one or more isotope abundance ratios are measured and the measured data is subsequently extrapolated back to "time zero", the time when the sample gas was first introduced into the mass analyser in order to account for consumption and isotope fractionation by ionisation of the gas during measurement.

It is important to capture all measured isotope ratios starting from "time zero" in order to deduce the accurate isotope ratio from the measured data. However, there are problems with the known measurement methods and apparatus. The ionizing electron beam inside the ionization volume of the electron impact ion source is generated from a hot filament by thermionic electron emission. The ion source conditions have to be kept stable over time in order to avoid any distortion of the measured isotope ratios. For example, changes in filament temperature during sample measurement would result in uncontrolled isotope fractionation and affect the accuracy and precision of the measurement. Changes in filament current during the measurement might influence the space charge conditions inside the ionization volume and thus affect the mass discrimination of the ion source. Furthermore, there is an initial equilibration time or period, starting from time zero until the different isotopes have evenly spatially dispersed throughout the volume of the mass spectrometer. Because of the increased viscosity, this equilibration time can last longest for the heavier noble gases such as Xenon, which can take several minutes (e.g. up to 10 minutes) before all isotopic species of the noble gas sample have been fully equilibrated from the sample prep line into the volume of the mass spectrometer. For example, equilibration can take about 3 minutes for argon, or 6 to 7 minutes for Xenon. The equilibration time will depend on characteristics of the particular instrument as well as of the gas.

As a result of the equilibration time, the measured isotope abundance over time can show a behaviour from time zero, $t_0$, as shown schematically by curve 4 (solid line) in FIG. 1. There is typically a fast rise 6 in the measured isotope abundance as the isotopes fill the spectrometer following their introduction, which is followed by a decrease, for example a linear or substantially linear decrease 8 after a time $t_{eq}$ as the isotopes are gradually consumed. The ionization source itself causes fractionation of the isotopes and therefore a change in isotope ratio with time. Space charge effects and the different kinetics of the lighter compared to the heavier isotopes result in slightly different transmission and ionization probabilities. Because of preferential ionization of one isotope over another, the isotopic composition of the gas inside the evacuated system changes over time and, as such, the measured isotope ratio changes over time. In order to calculate the true isotopic composition of the sample it is important to measure all isotopes right from the point of introduction of the sample. Therefore, an extrapolation 7 of the stable, equilibrated, and decreasing part of the isotope intensity measurement back to time zero (moment of gas introduction) is required to calculate an isotope ratio of the gas at time zero. Curve fitting is performed to extrapolate the isotope intensity to time zero. In the state of the art, typically measurement of the isotopes will only begin after the equilibration phase, i.e. in the stable, linear behaviour phase, even though the gas has been subject to ionization since it was first introduced into the spectrometer. For example, as shown schematically in FIG. 2, measurements for an argon sample typically may not be taken before 200 seconds have passed since the gas was introduced and a linear behaviour is observed. Usually the intensity, i.e. abundance, of the isotopes is measured over time, rather than the ratio. A best fitting of the measured ion beam intensity is performed and extrapolated back to time zero for each isotope. An isotope ratio is then calculated at time zero from the ratio of the time zero intensities of two isotopes.

As mentioned, the period before the observed linear decrease in isotope abundance commences corresponds to the equilibration time and is most evident for the heavier noble gases, e.g. argon to xenon. In state of the art systems, in order to keep ion source conditions stable, ionization of the sample gas begins from the moment the sample is introduced into the mass spectrometer vacuum. However, this means that the isotopes are being consumed in an uncontrolled and unknown way so that the isotope abundance ratios are disturbed by the time the gas is equilibrated (the initial isotope ratio measured in the equilibration time would not be consistent with the measured isotope ratios in the equilibrated period). Furthermore, the ionisation and consumption of gas during the equilibration phase is another source of isotope fractionation. This fundamental limitation today causes one of the major uncertainties in noble gas isotope ratio mass spectrometry.

The invention is aimed at addressing this problem, amongst others.

SUMMARY

The invention involves lowering the electron energy (i.e. electron impact energy) of the electron impact ionization source or keeping the energy level low during an initial equilibration time of the sample gas into the mass spectrometer. The reduced electron energy ensures that no sample gas is ionized during the initial sample equilibration phase. Once the initial equilibration phase is completed, the ionizing electron beam energy can be raised so that sample gas is ionized. The electron energy can be lowered or kept below the ionization potential of the sample gas and then raised to or above the ionization potential of the sample gas.

According to one aspect of the invention there is provided a method of static gas mass spectrometry comprising the steps of: introducing a sample gas comprising two or more isotopes to be analyzed into a static vacuum mass spectrometer at a time, $t_0$ operating an electron impact ionization source of the mass spectrometer with a first electron energy below the ionization potential of the sample gas for a first period of time that is following $t_0$ until a time $t_1$; operating the electron impact ionization source with a second electron energy at least as high as the ionization potential of the sample gas for a second period of time that is after time $t_1$.

The second period of time generally starts immediately after time $t_1$.

The method can comprise the step of mass analyzing the two or more isotopes (for example to determine their isotope ratio). The mass analysis generally begins after the first period of time, since ionization of the sample gas is inhibited during the first period of time. The mass analysis thus preferably begins with the second period of time. Preferably, the mass analysis is performed during the second period of time.

The invention also provides a static gas mass spectrometer for performing the method.

The invention in another aspect provides a static mass spectrometer comprising: an ion source, in particular an electron impact ionization source, to receive a sample gas to be ionized, a mass analyzer, in particular a magnetic sector mass analyzer but alternatively a quadrupole or TOF mass analyzer, for mass analyzing the generated ions, an ion detector, in particular a multicollector (especially where a magnetic sector mass analyzer is used) but alternatively a single collector, for detecting ions that have been mass analyzed, and at least one pump for generating a vacuum in the mass spectrometer (i.e. a vacuum in the ion source and/or mass analyser and/or ion detector, preferably in all of these).

Preferably, the at least one pump can be isolated from the mass spectrometer before a sample gas is received by the ionization source, thereby to provide a static vacuum in the spectrometer.

The ion source generates ions of a sample gas fed into the ion source, in particular when the electron energy of the electron impact ionization source is at least as high as the ionisation potential of the gas. The mass analyzer then analyses the ions generated in the ion source and the ion detector detects the mass analyzed ions. The ion source can be configured as an electron impact ionization source operable with a first electron energy below the ionization potential of the sample gas for a first period of time following a sample gas introduction into the ion source $t_0$ until a time $t_1$; and operable with a second electron energy at least as high as the ionization potential of the sample gas for a second period of time that is after time $t_1$. The electron energy may be maintained at the low level from a time before the gas is introduced (i.e. it is already low when the gas is introduced).

The vacuum in the mass spectrometer is preferably at least a high vacuum (for example of a pressure $1\times10^{-7}$ mbar or lower, or a pressure $1\times10^{-8}$ mbar or lower). The vacuum may be an ultra high vacuum (for example of a pressure $1\times10^{-9}$ mbar or lower).

A controller is preferably provided for controlling the electron energy of the ion source. The controller is preferably for controlling the electron energy in accordance with the method of the invention. The controller can include a computer, which can, for example, execute firmware or software to control the electron energy. Preferably, the controller comprises a computer that controls the electron energy (include the duration that the energy is applied) based on an input of the type of gas. The controller can include electronics for varying an electron extraction voltage of the ion source and thereby the electron energy. The computer of the controller preferably controls the electronics, for example based on an input of data defining the type of gas, e.g., the species of noble gas, and/or the first and second periods of time (such as the start and end of the periods). The input of data may include the time $t_0$ of gas introduction and the time $t_1$ e.g. for raising the electron energy and starting mass analysis. The input data can be user input or software derived.

The method is preferably a method for determining at least one isotope ratio of the sample gas, i.e. a method of isotope ratio mass spectrometry (IRMS).

The sample gas is preferably a noble gas, for example He, Ne, Ar, Kr, Xe, Rn, especially, Ar, Kr, Xe, which have significant equilibration times. However, the sample gas may be another gas that can be isotopically analyzed in the mass analyser, such as $CO_2$ or $N_2$ for example. Other gases may be present with the sample gas to be analyzed but preferably the sample gas (e.g. noble gas) to be analyzed is clean from other gases.

The first time period from $t_0$ to $t_1$ is preferably a period that allows the isotopes of the sample gas to equilibrate (i.e. reach equilibrium) in the mass spectrometer. Accordingly, the first time period from $t_0$ to $t_1$ is a period corresponding to a period taken for the isotopes of the sample gas to equilibrate in the mass spectrometer. Thus, time $t_1$ is preferably after the isotopes of the sample gas have equilibrated. The equilibration refers to the spatial (geometrical) equilibration of the sample gas isotopes within the vacuum space of the mass spectrometer. The time period from $t_0$ to $t_1$ is preferably at least equal to the time for the sample gas to equilibrate. The equilibration time depends on the type of gas, in particular due to its viscosity. The heavier gases tend to have a higher viscosity than lighter ones and consequently need longer equilibration times. Typically, the time period from $t_0$ to $t_1$ is not significantly or substantially longer than the time for the sample gas to equilibrate. The equilibration period from $t_0$ to $t_1$ can be at least 0.1, 0.5, 1, 1.5, 2, 2.5, 3, 3.5, 4, 5, 5.5, 6, 6.5, 7, 8, 9, 10, 11, 12, 13, 14, or 15 minutes depending on the masses of the isotopes. In some embodiments, the sample gas can be introduced to the ion source and spectrometer with an electron impact ionization energy above the ionisation potential of the gas and the ion (isotope) intensities can be followed with time to ascertain the point in time when the intensities follow a steady fit model with a generally stable negative slope (decreasing intensity). When the sample is introduced the measured ion abundance intensity first increases (positive slope), then it reaches a maximum (slope zero) before it starts to follow a negative slope with a stable or uniform signal decay. Stability due to sufficient equilibration of the gas can be deemed to be achieved when the fit function fits the decay curve well. Once this equilibration time has been determined it can be applied as the waiting time (first time period) for real sample measurements when the reduced electron energy is applied before the energy of the electrons is set to the ionization mode.

The equilibration period can be determined by a previous measurement of an isotope ratio (IR) of the sample gas with time (IR v. time plot) following sample gas introduction, i.e. from time $t_0$. In such embodiments, the time at which the isotope ratio starts to uniformly decrease, for example in a linear or substantially linear manner, can be defined as the end of the equilibration period and therefore used to determine $t_1$. A respective equilibration time can therefore be known, and used to determine $t_1$, from previous measurements for each species of gas, for example noble gas. The measurement of the isotope ratio by the mass spectrometer can be made from $t_1$ after the electron energy of the ion source has been raised above the ionization potential.

The electron energy of the electron impact ion source can be controlled by changing the extraction voltage applied to a heated filament of the ion source. The extraction voltage is therefore preferably variable. The extraction voltage can be applied by an extraction voltage electrode.

The first electron energy of the ion source lower than the ionization potential of the sample gas may be lower than the ionization potential by at least 2 eV, or at least 4 eV, or at least 6 eV, or at least 8 eV, or at least 10 eV, or at least 12 eV. For example, the first electron energy lower than the ionization potential can be 10 eV or about 10 eV (which can be compared to ionization potentials of the noble gases: He (24.6 eV), Ne (21.6 eV), Ar (15.8 eV), Kr (14 eV) and Xe (12.1 eV)). Preferably, the first electron energy is below the ionization potential of a component of the sample gas to be mass analyzed. The second electron energy of the ion source is at least as high as, preferably higher than, the ionization potential of the sample gas. The second electron energy can be at least 2 times, or at least 3 times, or at least 4 times, or at least 5 times the ionization potential. The second electron energy of the ion source higher than the ionization potential of the sample gas can be higher than the ionization potential by at least 10 eV, or at least 20 eV, or at least 30 eV, or at least 40 eV, or at least 50 eV, or at least 60 eV, or at least 70 eV. For example, the second electron energy can be 80 eV or about 80 eV (which can be compared to the above mentioned ionization potentials of the noble gases). The second electron energy can be, with general preference, at least 2×, or at least 3×, or at least 4×, or at least 5×, or at least 6×, or at least 7×, or at least 8×, or at least 9×, or at least 10× the first electron energy. These ranges can be combined, for example the second electron energy can be higher than the ionization potential of the sample gas by at least 20 eV and be at least 2× the first electron energy, or the second electron energy can be higher than the ionization potential of the sample gas by at least 30 eV and be at least 3× the first electron energy, or the second electron energy can be higher than the ionization potential of the sample gas by at least 40 eV and be at least 4× the first electron energy, or the second electron energy can be higher than the ionization potential of the sample gas by at least 50 eV and be at least 5× the first electron energy. The electron emission current from the filament (ionizing current) is preferably of the order of several hundred μA (e.g. 100-500 μA, or 200-400 μA).

The filament heating current (typically several amps, for example in the range 2 A to 5 A) for the filament of the electron impact ionization source can be kept the same or substantially the same during the first period, before $t_1$ (when applying the first electron energy), and during the second period after $t_1$ (when applying the second electron energy). A constant filament current can ensure a substantially constant filament temperature and ion source temperature are maintained. However, in some embodiments, the change in electron energy may have a small temperature-changing effect on the filament. When the electron energy is reduced the electrons will not be accelerated away from the filament so much and the filament may run hotter. In order to compensate for this it is preferred to adjust the filament heating current. In this case, the filament current can be adjustable and can be changed to maintain a substantially constant filament temperature and therefore ion source temperature. Thus, preferably, as the electron impact energy is changed, the filament heating current is also changed in order to keep the temperature inside the ion source region stable. Therefore, the invention preferably comprises changing electron energies and filament heating currents concurrently to maintain the filament temperature substantially constant. The invention thus seeks to achieve both a constant ion source temperature throughout as well as a reduced electron energy during the equilibration phase. A preferred feature of the invention is therefore regulating a filament heating current of a filament of the electron impact ionization source so as to keep the temperature of the ionization source substantially the same during the first period and the second period.

A temperature monitor, such as a pyrometer, can be provided in or adjacent the ionization source (or in the region thereof) to measure the temperature of the filament and provide a feedback signal to control the filament current (for example via a controller) so as to maintain substantially constant filament temperature throughout, i.e. during the first and second periods. Preferably, a change of filament current with change of electron energy can be calibrated in this way, e.g. using a pyrometer.

The reduced electron energy in the first period from $t_0$ to $t_1$ can ensure that no sample gas is ionized during the initial sample equilibration phase. Once the initial equilibration phase is completed, the ionizing electron beam energy is raised to a usual level for ionizing sample gases in a static gas mass spectrometer, e.g. at least 50 eV, or at least 60 eV, or at least 70 eV, such as about 80 eV, for noble gases. The second, higher energy level can ensure high ionization yields inside the ion source.

It can be see that the invention therefore provides improvements related to sample introduction and sample measurement in noble gas isotope ratio mass spectrometry running under static vacuum conditions. Advantageously, the invention addresses the problem of sample gas consumption and/or isotope fractionation during the initial equilibration phase following the sample gas introduction into the static mass spectrometer, which previously affected the accuracy of isotope ratio measurements. As a consequence, the invention can eliminate a major uncertainty in the calculation of the isotope ratios from the measured data set. As the isotope fractionation and gas consumption during the equilibration time can be corrected for, another advantage of the invention is to enable a significant decrease in the volume of the gas preparation system and, therefore importantly, to increase the effective sensitivity without the usual concerns for gas conductance. The preparation volume could therefore be made very small because the length of equilibration time is no longer such a significant concern.

In accordance with an embodiment, isotope ratio mass analysis measurements are taken during the second time period, not the first time period, once the gas isotopes have equilibrated in the ion source and once the electron energy is increased above the gas ionization potential. The isotope ratio mass analysis measurements preferably begin at or after time $t_1$. Preferably, for each of two or more isotopes, the intensity, i.e. abundance, of the isotope is measured over time. A best fit, such as linear interpolation for example, of each measured isotope intensity with time can be performed and extrapolated back to time zero, i.e. the time when the second electron energy is raised at least as high as the ionization potential of the sample gas. In the present invention, time zero thus means the time when the electron energy is adjusted to the ionization mode, i.e. $t_1$. Time zero is therefore the time when ionization starts to consume or change the isotope abundances of the sample gas, which in the prior art is when the gas is introduced into the spectrometer ($t_0$) but in the invention is $t_1$ when the ionization begins. The ratio of the extrapolated time zero isotope intensities gives the isotope ratio value of the sample gas. In a variation of this method, an isotope ratio of two isotopes could be calculated for each time point that the individual isotope abundances are measured, thereby providing a plurality of isotope ratios with time, which can be fitted by a best fit line that is extrapolated to time zero when ionization begins (in this case $t_1$) to determine the (accurate) isotope ratio. The invention enables a workflow for introducing a sample gas into a static gas mass spectrometer, particularly for noble gases. The ion source temperature conditions can be kept stable all the time while a reduced electron beam energy below the first ionization energy of the sample gas is applied during the initial equilibration time of the sample into the mass spectrometer. Sample gas consumption during the initial equilibration phase is thereby eliminated and is no longer a limitation for high precision isotope ratio measurements, especially for noble gases.

DESCRIPTION OF PREFERRED EMBODIMENTS

In order to enable a more detailed understanding of the invention, embodiments will now be described by way of example and with reference to the accompanying drawings.

Figure 1:
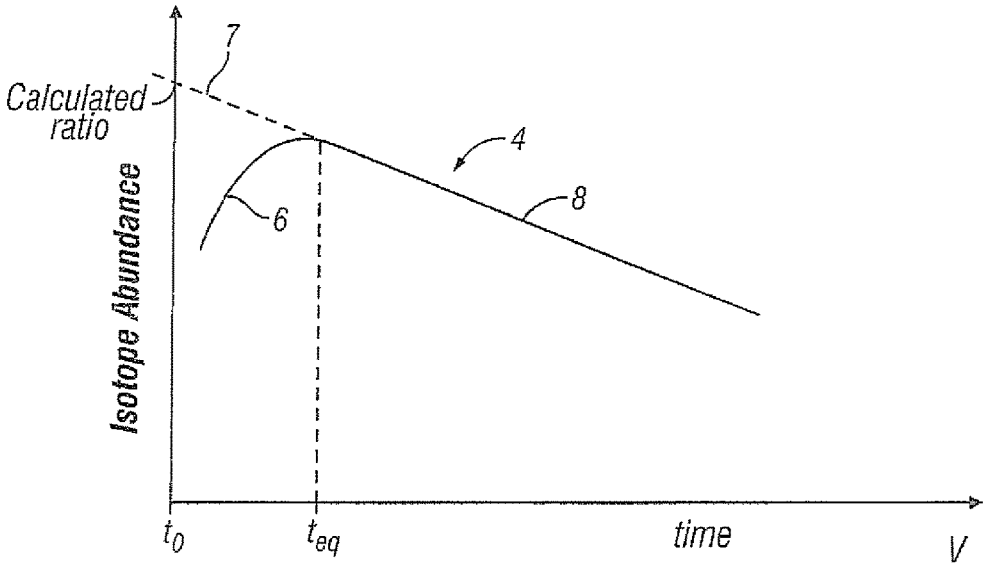
FIG. 1 PRIOR ART
FIG. 1 shows schematically a prior art measured isotope abundance over time from time zero.
Figure 2:
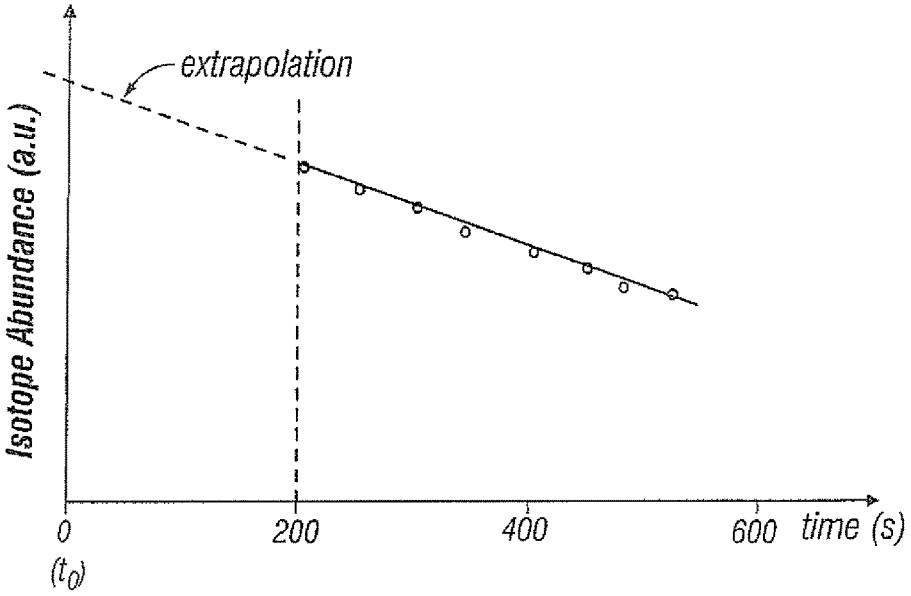
FIG. 2 PRIOR ART
FIG. 2 shows schematically a prior art measurement of isotope abundance over time for an argon sample.
Figure 3:
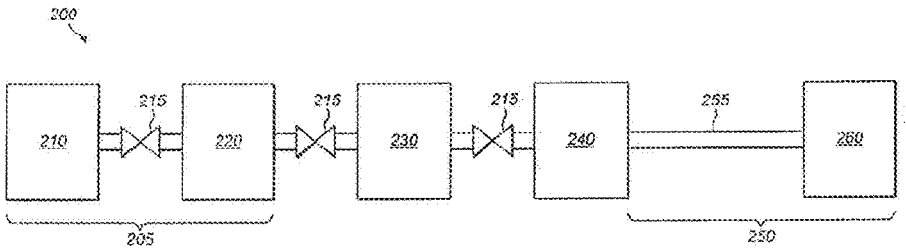
FIG. 3 shows schematically a configuration of a static mass spectrometer according to an embodiment.

Referring to FIG. 3, there is shown schematically a typical configuration of a static mass spectrometer 200, which can be used in the invention, comprising: a sample preparation region 205; a transfer region 230; an ion source region 240; and a mass analyzer 250. The sample preparation region 205 comprises a chamber 210 (such as a furnace or laser irradiated chamber) and an optional preparation bench 220. Between each of the furnace 210, the sample preparation bench 220, the transfer region 230 and the ion source region 240, valves 215 are provided.

The admission to the static mass spectrometer 200 is indirect via an intermediate chamber. A normal application is the determination of the isotope ratios of various isotopes of a noble gas that is trapped in a sample, such as a piece of rock or similar.

In current instruments, the sample, typically a piece of rock, is put into a chamber (such as furnace 210) and then heated, possibly with a laser. This treatment releases trapped gases, which comprise the desired analytes. The released gases are transferred to the sample preparation bench 220, where they may be manipulated in various ways. For example, they may be partially or wholly transferred to storage volumes ("pipettes") and then they may be partially released, giving a smaller amount of sample at a lower pressure.

In other cases the gas can be a gas sample directly, for instance an air gas sample.

The gas is then transferred to the transfer region 230, which may act as a cleaning unit. In older devices, the sample gas was collected on a cold finger. The gases could then be thawed to "distil" the gases, releasing them one after another. More modern devices comprise a general type of "trap" installed, typically comprising chemical getters, and optionally cold traps, to remove unwanted substances (this usually means everything but noble gases). The vacuum pump or pumps (not shown) to the mass spectrometer (i.e. to the ion source and mass analyser) are closed off by valves (not shown) before the sample is released into the chambers (240, 250).

From here, the sample gas is equilibrated with the ion source region 240 where the gas is subsequently ionized following equilibration (by electron ionization) and the generated ions are subsequently analyzed in the mass analyzer 250.

In the ion source 240, the gas to be analyzed is typically ionized by means of electron bombardment (electron impact ionization). Due to the statistical distribution in the mass spectrometer of the gas to be analyzed, there are only a small number of molecules in the region of the ion source. This therefore results in only a small ion stream and hence a requirement for high detection sensitivity.

Typical pressures in the ion source region 240 and mass analyzer 250 are $10^{-9}$ to $10^{-10}$ mbar before the sample is admitted and subsequently, $10^{-6}$ to $10^{-7}$ mbar (or $10^{-7}$ to $10^{-9}$ mbar), depending on the sample amount (which cannot always be predicted). The gas to be analyzed spreads throughout the ion source region 240 and the mass analyser 250, with a small number of molecules entering the ion source. In the mass analyser 250, the ions generated from the ion source travel along a flight path, such as along flight tube 255, before being detected in detector region 260.

The strong vacuum and the removal of "undesired" gases from the sample are important in order to improve the signal to noise ratio (that is the ion count from the sample gas against the ion count from other gases, such as remaining from a previous measurement or from other "interferences", such as isobaric ions, like hydrocarbons).

Figure 4:
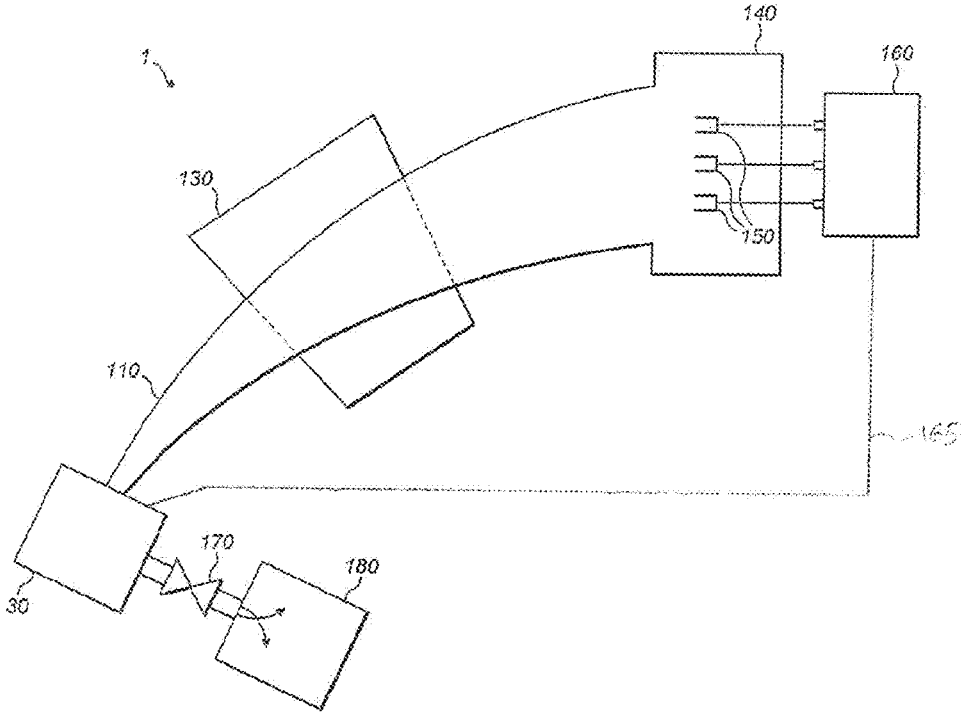
FIG. 4 shows schematically an arrangement of a static mass spectrometer according to another embodiment.

Referring now to FIG. 4, there is shown schematically an arrangement with further details of a static mass spectrometer in accordance with the invention. The overall arrangement of the static mass spectrometer of FIG. 4 does not differ significantly from that shown in FIG. 3. The static mass spectrometer 1 comprises: an electron impact ion source 30; a flight tube 110; a magnetic sector mass analyser 130; a detector housing 140; a multicollector detector arrangement 150; and electronics 160. A vacuum pump 180 is coupled to the ion source assembly 30 via an automatic valve 170. A sample preparation region and gas transfer region, as described with reference to FIG. 3, is not shown in this drawing, but would typically be included. Additionally a further vacuum pump (not shown) is connected to the detector housing 140, with a valve (also not shown).

The detector arrangement 150 is shown as a multicollector device, comprising a plurality of collectors for detection of ions. This could comprise at least one Faraday cup, at least one ion counter, or a combination thereof, such as described in WO-2012/007559, which is commonly assigned. Three collectors are shown in FIG. 4, but a preferred embodiment has five collectors and embodiments with more collectors are envisaged as well. The electronics 160 may comprise electronics and/or a computer of a detection system for data acquisition, storage and/or processing. Moreover, the electronics 160 comprises a controller, which further comprises ion source control, valve control, pump control, etc.

Figure 5:
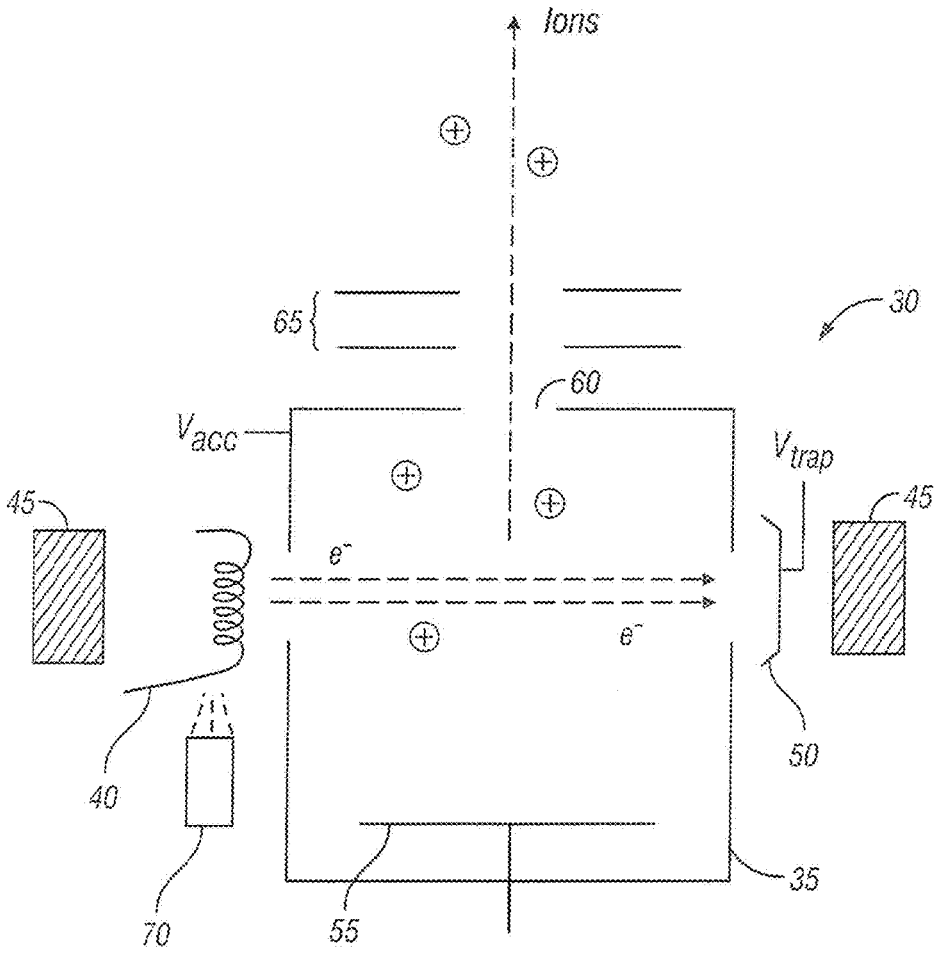
FIG. 5 shows schematically an arrangement of an electron impact ionisation source according to a further embodiment.

Turning next to the ion source, FIG. 5 shows schematically the arrangement of the electron impact ionization source 30 of FIG. 4 for use in the invention. The electron impact ion source 30 is a Nier type. The neutral sample gas is admitted into the ionisation chamber 35, which is generally held at high voltage (e.g. 3-5 kV). Electrons are produced by thermionic emission from a filament 40 that is heated by passing a heating current through it and the electrons are accelerated by an extraction voltage applied to trap electrode 50 (e.g. 10-100V). Magnets 45 cause the electrons to follow a helical path across the chamber. The electrons, provided they have sufficient energy, ionise the gas and the gas ions are extracted by the high voltage as applied to the repeller 55 and chamber 35. The ion beam is generated through the extraction slit 60 and can be steered and/or focussed by focus electrodes 65. The ion source 30 is controlled by a controller that is part of electronics 160 as shown schematically by line 165 in FIG. 4.

In use, once the sample of noble gas is introduced into the ion source 30 from the gas preparation and transfer region at a time $t_0$, there follows an initial equilibration time of the isotopes of the gas into the mass spectrometer. The controller of the electronics 160 controls the electron energy voltage, i.e. extraction voltage to electrode 50, to lower the electron impact energy from the usual ~80 electron volts typically used to ionise noble gases, for example, xenon, down to 10 electron volts. This lower level of electron energy is below the ionization potential of the noble gas that is to be analyzed. The reduced electron energy ensures that no sample gas is ionized during the initial sample equilibration phase. The energy may be kept at the low level (first energy) at all times except during the ionization and mass analysis period (second period), so that it is already at the low level from a time before the gas is introduced to the spectrometer. After a first time period from $t_0$, at a time $t_1$ the controller increases the electron energy so that the ionizing electron beam energy is reset to the usual high level, such as ~80 eV, to ensure high ionization yields of noble gas inside the ion source.

By inputting to the controller, which can comprise a computer, the type of noble gas to be detected in the mass analysis the controller can select and set both the period of the equilibration time (the first period from $t_0$ to $t_1$) and optionally the first (lower) and second (higher) electron energies. The duration of the first period for each sample gas species to be set by the controller can be determined from a previous measurement of the isotope intensity with time from which the time for equilibration can be found. The first (lower) and second (higher) electron energies in some embodiments can be set to values that are applicable for all noble gas species from He to Xe and thus do not need to be set specifically for each gas species. These could be, for example, 12 eV or lower, or 10 eV or lower for the first electron energy and at least 50 eV, 60 eV, 70 eV or 80 eV for the second electron energy.

All the time the filament heating current is kept constant, i.e. the same during the sample measurement (mass analysis phase) as during the equilibration phase. Only the electron impact energy is changed. The ion source conditions should be kept stable over time in order to avoid distortion of the measured isotope ratios. Any change in filament temperature during sample measurement may result in uncontrolled isotope fractionation and affect the accuracy and precision of the measurement. To better ensure that the filament and hence in source temperature remains substantially constant, for example in view of changes to the electron energy, a pyrometer 70, can be provided adjacent the filament 40 to monitor the temperature of the filament and provide a feedback signal to the controller 160 to control the filament current so as to maintain substantially constant filament temperature. A change of filament current with change of electron energy can be calibrated this way.

It can be seen from above that the invention addresses the problem of sample consumption during the equilibration phase of the sample gas introduction into the static gas mass spectrometer, which is currently a significant limitation for high precision isotope ratio measurements of the heavier noble gases. According to the invention, during the first, equilibration phase the electron energy is maintained below the first ionization potential of the gas but all other ion source parameters are substantially unchanged compared to the subsequent phase after the first, equilibration phase. After the first, equilibration phase has passed, the electron energy is increased to achieve the necessary high ionization yields (all other ion source parameters remaining substantially unchanged as mentioned). The reduced electron energy avoids ionization of the sample gas during the first equilibration phase and thus does not consume any sample gas, which would involve preferentially consuming some isotopes over others. Such a workflow can help to avoid a distortion of the measured isotope ratios that conventionally occurs during the first equilibration phase. The ion source temperature conditions can be kept stable all the time while only reducing the ionizing electron beam energy during the initial equilibration time of the sample into the mass spectrometer below the first ionization energy of the gas.

Figure 6:
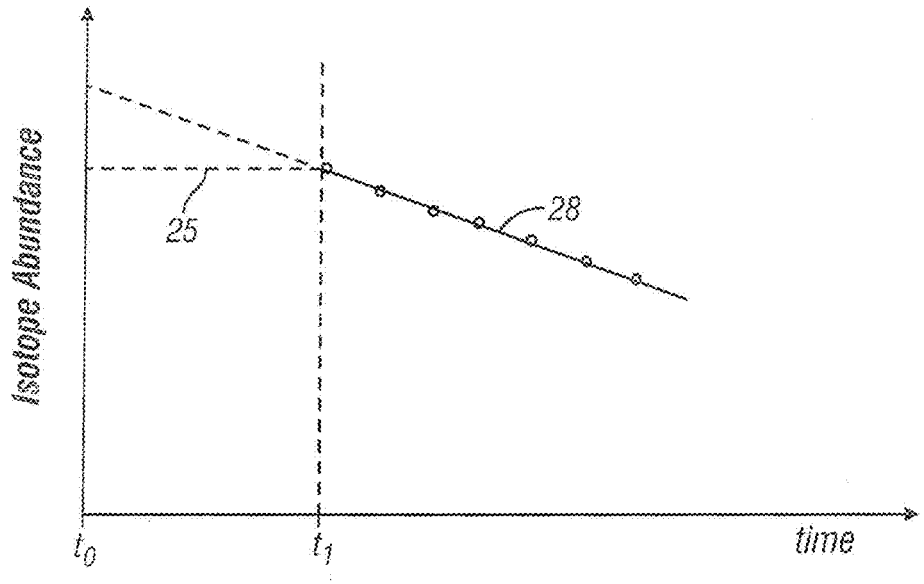
FIG. 6 shows schematically a measured isotope abundance according to an embodiment measuring from time $t_1$ after an isotope equilibration phase.

Referring to FIG. 6, which shows schematically a measured isotope abundance 28 of a noble gas according to an embodiment of the invention, the isotope ratio mass analysis measurements begin at or after time $t_1$ (i.e. when the second time period starts) once the gas isotopes have equilibrated in the ion source and once the electron energy is increased above the gas ionization potential. The plot of FIG. 6 shows the intensity, i.e. abundance, of an isotope over time. Two or more different isotopes are measured in all. The curves for the different isotopes are slightly different because of changing mass bias and changing gas composition because of slightly different ionization probabilities of the different isotopes. A best fit, such as linear interpolation for example, of the measured ion beam intensity is performed and extrapolated back to time zero for each isotope. An isotope ratio is then calculated from the ratio of the time zero intensities of two isotopes. A ratio of any two isotopes, usually of the same element, can be obtained in this way. The problem in the prior art is that during the time required for equilibration immediately following gas introduction to the ion source and spectrometer, sample gas already becomes consumed in an uncontrolled way and heavier and lighter isotopes are ionized in an uncontrolled way. Even more, this uncontrolled fractionation and ionization during the initial equilibration time window results in a change of the isotope composition of the remaining gas, which is a fundamental limitation to high precision isotope ratio measurements of gases. The prior art time zero extrapolation back to when the gas is introduced cannot correct for this. With the invention, since no gas ionization or consumption has occurred prior to time $t_1$ in the equilibration phase, the time zero for the present invention is in fact $t_1$ and the isotope ratio calculated from the measurements or best fit curves of the isotope intensities at this time zero will be a more accurate measurement than in the prior art method in which ionization occurs from the moment the gas is introduced to the ion source.

In the present invention, time zero means the time when the electron energy is adjusted to the ionization mode, i.e. $t_1$. Time zero is the time when ionization starts to consume or change the isotope abundances of the sample gas, which in the prior art is when the gas is introduced into the spectrometer ($t_0$) but in the invention is $t_1$ when the ionization begins. In other words, the isotope intensity of the respective isotopes 25 at time $t_1$ can be used to calculate the accurate isotope ratio of the gas. However, a single measurement at time $t_1$ could be prone to error. In practice, due to limitations of measurement precision, it is better that several measurements are made from time $t_1$ onwards and plotted against time so that a best fit line through them can be made. Then the value of the fitted line at the time zero of $t_1$ can provide the intensity to calculate the isotope ratio.

Figure 7:
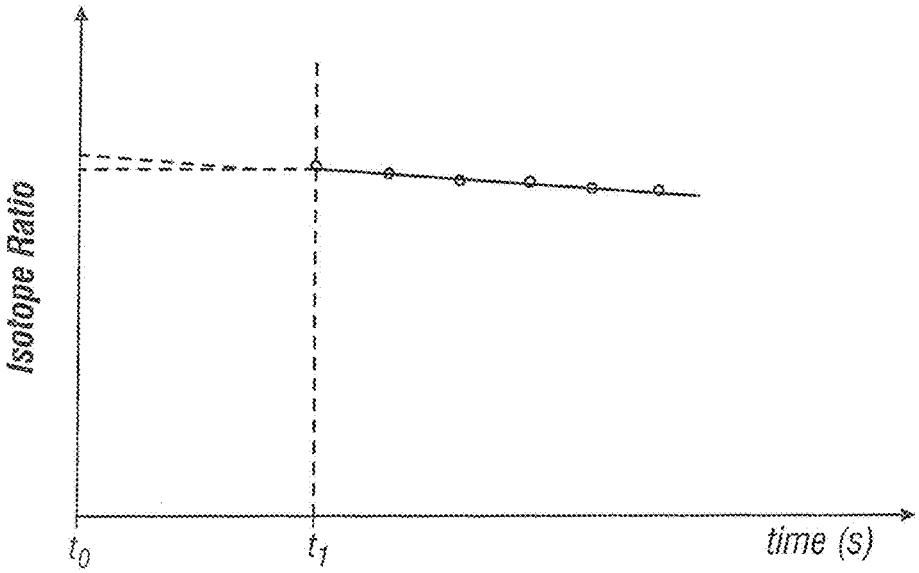
FIG. 7 shows schematically a measured isotope ratio according to an embodiment measuring from time $t_1$ after an isotope equilibration phase.

It will be appreciated that in most embodiments the individual isotope abundances will each be measured and fitted by a best fit line that is extrapolated from which an (accurate) isotope ratio is calculated from the extrapolated line at time zero (in this case $t_1$). However, in other embodiments, instead the isotope ratio could be calculated for each time point that the individual isotope abundances are measured, thereby providing a plurality of isotope ratios with time, which can be fitted by a best fit line that is extrapolated to time zero (in this case $t_1$) to determine the (accurate) isotope ratio. This is shown schematically in FIG. 7.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A method of static gas mass spectrometry comprising the steps of:

introducing a sample gas comprising two or more isotopes to be analyzed into a static vacuum mass spectrometer at a time, $t_0$;

operating an electron impact ionization source of the mass spectrometer with a first electron energy below the ionization potential of the sample gas for a first period of time that is following $t_0$ until a time $t_1$, wherein the first time period from $t_0$ to $t_1$ is set based on a previous determination of an equilibration period taken for the isotopes of the sample gas to equilibrate in the mass spectrometer; and operating the electron impact ionization source with a second electron energy at least as high as the ionization potential of the sample gas for a second period of time that is after time $t_1$;

wherein isotope ratio measurements are taken by the spectrometer during the second period but not during the first period.

2. The method of claim 1 further comprising regulating a filament heating current of a filament of the electron impact ionization source so as to keep the temperature of the ionization source substantially the same during the first period and the second period.

3. The method of claim 1 further comprising the step of mass analyzing the two or more isotopes in the mass spectrometer beginning with the second period of time.

4. The method of claim 3 wherein the step of mass analyzing comprises determining at least one isotope ratio of the sample gas.

5. The method of claim 4 wherein the mass analyzing comprises, for each of two or more isotopes, measuring the intensity of the isotope over time; performing a best fit of each measured isotope intensity with time, extrapolating each best fit to a time zero when the second electron energy is raised at least as high as the ionization potential of the sample gas, and calculating a ratio of the extrapolated time zero isotope intensities of two isotopes to give an isotope ratio of the sample gas.

6. The method of claim 1 wherein the sample gas is a noble gas.

7. The method of claim 1 wherein the first time period from $t_0$ to $t_1$ is not significantly longer than a time for the sample gas to equilibrate in the mass spectrometer.

8. The method of claim 1 wherein the first time period is at least 0.1, 0.5, 1, 1.5, 2, 2.5, 3, 3.5, 4, 5, 5.5, 6, 6.5, 7, 8, 9, 10, 11, 12, 13, 14 or 15 minutes.

9. The method of claim 1 wherein the first electron energy of the ionization source is lower than the ionization potential by at least 2 eV, 4 eV, 6 eV, 8 eV, 10 eV, or 12 eV.

10. The method of claim 1 wherein the first electron energy of the ionization source is about 10 eV.

11. The method of claim 1 wherein the second electron energy of the ionization source is higher than the ionization potential of the sample gas by at least 10 eV, or 20 eV, or 30 eV, or 40 eV, or 50 eV, or 60 eV, or 70 eV.

12. The method of claim 1 wherein the second electron energy of the ionization source is about 80 eV.

13. The method of claim 1 wherein the second electron energy is at least 2×, or 3×, or 4×, or 5×, or 6×, or 7×, or 8×, or 9×, or 10× the first electron energy.

14. A static gas mass spectrometer comprising:

an electron impact ionization source for receiving a sample gas comprising two or more isotopes and ionising the sample gas, a controller to control the electron impact ionization source, a mass analyzer for mass analyzing the generated ions, an ion detector for detecting ions that have been mass analyzed, and at least one pump for generating a vacuum in the mass spectrometer, which can be isolated from the mass spectrometer before a sample gas is received by the ionization source, wherein the ionization source is operable with a first electron energy below the ionization potential of the sample gas for a first period of time following a sample gas introduction into the ion source at time $t_0$ until a time $t_1$; and operable with a second electron energy at least as high as the ionization potential of the sample gas for a second period of time that is after time $t_1$, wherein the controller controls the electron energy of the ionization source and sets the first time period from $t_0$ to $t_1$ based on a previous determination of an equilibration period taken for the isotopes of the sample gas to equilibrate in the mass spectrometer.

15. The static gas mass spectrometer of claim 14 wherein the first time period from $t_0$ to $t_1$ is not significantly longer than a time for the sample gas to equilibrate in the mass spectrometer.

16. The static gas mass spectrometer of claim 14 wherein the vacuum is an ultra high vacuum, the mass analyzer is a magnetic sector mass analyzer and the ion detector is a multicollector.

17. The static gas mass spectrometer of claim 14 further comprising a temperature monitor to measure the temperature of a filament of the electron impact ionization source and provide a feedback signal to control a filament current supplied to the filament so as to maintain substantially constant filament temperature during the first and second periods.

* * * * *